US011352805B2

(12) United States Patent
Hughes et al.

(10) Patent No.: US 11,352,805 B2
(45) Date of Patent: Jun. 7, 2022

(54) SAFETY PORTAL SYSTEM

(71) Applicant: Safe Portal Tech, LLC, Woodward, OK (US)

(72) Inventors: Dwight Hughes, Woodward, OK (US); Billy R. Riggs, Woodward, OK (US)

(73) Assignee: Safe Portal Tech, LLC, Woodward, OK (US)

( * ) Notice: Subject to any disclaimer, the term of this patent is extended or adjusted under 35 U.S.C. 154(b) by 0 days.

(21) Appl. No.: 17/198,877

(22) Filed: Mar. 11, 2021

(65) Prior Publication Data

US 2021/0285250 A1 Sep. 16, 2021

Related U.S. Application Data

(60) Provisional application No. 62/988,219, filed on Mar. 11, 2020.

(51) Int. Cl.

| | |
|---|---|
| ***E04H 9/06*** | (2006.01) |
| ***E04H 9/10*** | (2006.01) |
| ***E06B 5/10*** | (2006.01) |
| ***E04H 9/14*** | (2006.01) |
| ***E04H 9/16*** | (2006.01) |
| ***E04H 1/12*** | (2006.01) |

(52) U.S. Cl.

CPC ..... *E04H 9/06* (2013.01); *E04H 1/125* (2013.01); *E04H 9/10* (2013.01); *E04H 9/14* (2013.01); *E04H 9/16* (2013.01); *E06B 5/10* (2013.01)

(58) Field of Classification Search

CPC .. E04H 1/125; E04H 9/06; E04H 9/10; E04H 9/14; E04H 9/16; E06B 5/10

See application file for complete search history.

(56) References Cited

U.S. PATENT DOCUMENTS

| | | | | | |
|---|---|---|---|---|---|
| 1,886,962 | A | * | 11/1932 | La Roche | E04B 1/34321 52/236.7 |
| 2,691,291 | A | * | 10/1954 | Henderson | E04B 1/34823 52/79.9 |
| 3,416,273 | A | * | 12/1968 | Stucky | E04B 1/34807 52/79.11 |
| 3,510,997 | A | * | 5/1970 | Ratych | E04B 1/34823 52/79.2 |
| 3,514,910 | A | * | 6/1970 | Comm | E04B 1/34807 52/79.11 |

(Continued)

*Primary Examiner* — Jessie T Fonseca

(74) *Attorney, Agent, or Firm* — Hall Estill Law Firm

(57) ABSTRACT

A safety portal system for use in existing building, such as schools. The safety portal system includes a first portal section. The first portal section includes a first wall and a second wall, a first open end, a floor portion and a ceiling portion, the at least one open end defined by an outer edge. In addition to the first portal section, the safety portal system includes a second portal section. The second portal section includes a first wall and a second wall, at least one open end, a floor portion and a ceiling portion. The at least one open end of the second portal section is defined by an inner edge that cooperates and engages with the outer edge of the first portal section to create a protective overlap section. A method of installing the safety portal system includes positioning the safety portal system in a desired building and assembling the safety portal system. The safety portal system can then be secured in its desired location within the building.

14 Claims, 5 Drawing Sheets

(56) References Cited

U.S. PATENT DOCUMENTS

| | | | | | |
|---|---|---|---|---|---|
| 3,550,334 | A * | 12/1970 | Van Der Lely | E04B 1/34823 | 52/79.7 |
| 3,716,954 | A * | 2/1973 | Kelbish | E04B 1/34815 | 52/79.2 |
| RE28,367 | E * | 3/1975 | Rich, Jr. et al. | E04B 1/34807 | 52/79.11 |
| 3,897,662 | A * | 8/1975 | Fencl | E04C 2/521 | 52/79.2 |
| 4,010,822 | A * | 3/1977 | Banner | A62B 5/00 | 182/18 |
| 4,107,886 | A * | 8/1978 | Ray | E04B 1/162 | 52/431 |
| 4,118,905 | A * | 10/1978 | Shelley | E04B 1/34823 | 52/236.4 |
| 4,525,975 | A * | 7/1985 | McWethy | E04B 1/34823 | 52/234 |
| 5,243,794 | A * | 9/1993 | Pikor | E04H 13/006 | 52/136 |
| 8,082,699 | B1 * | 12/2011 | Kychelhahn | E04B 1/6116 | 52/79.7 |
| 8,484,929 | B1 * | 7/2013 | Begdouri | E02D 29/045 | 52/745.03 |
| 9,702,138 | B1 * | 7/2017 | Rutherford | E04B 1/34853 | |
| 9,797,153 | B2 * | 10/2017 | Baggiero, II | E04H 9/14 | |
| 9,909,326 | B2 * | 3/2018 | Preston | E04G 1/17 | |
| 10,590,671 | B1 * | 3/2020 | Jee | E04B 1/34321 | |
| 2004/0118080 | A1 * | 6/2004 | Jazzar | E04B 1/164 | 52/745.19 |
| 2009/0056237 | A1 * | 3/2009 | Dickinson | E04H 9/14 | 52/79.5 |

* cited by examiner

SAFETY PORTAL SYSTEM

CROSS-REFERENCE TO RELATED APPLICATIONS

The present application is a conversion of U.S. Provisional application having U.S. Ser. No. 62/988,219, filed Mar. 11, 2020, which claims the benefit under 35 U.S.C. 119(e), the disclosures of which are hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Invention

The present disclosure relates to a safety portal system that can be implemented into an existing building or structure for the protection of people against external threats, such as ballistic projectiles.

2. Description of the Related Art

Protection of people from ballistic projectiles is an ever increasing concern, especially as it pertains to children in schools. Most existing buildings, such as schools, do not currently have any area that provides ballistic protection. Existing buildings certainly do not provide multiple, easily accessible areas that have ballistic protection. It is cost prohibitive to build entirely new buildings that include ballistic protection areas.

Accordingly, there is a need for a system that can be easily and affordably placed in an existing building to provide ballistic protection to the people in the buildings.

SUMMARY OF THE INVENTION

The present disclosure is directed to a safety portal system for use in existing building, such as schools. The safety portal system includes a first portal section. The first portal section includes a first wall and a second wall, a first open end, a floor portion and a ceiling portion, the at least one open end defined by an outer edge. In addition to the first portal section, the safety portal system includes a second portal section. The second portal section includes a first wall and a second wall, at least one open end, a floor portion and a ceiling portion. The at least one open end of the second portal section is defined by an inner edge that cooperates and engages with the outer edge of the first portal section to create a protective overlap section.

The present disclosure is also directed toward a method of installing the safety portal system. The safety portal system can be positioned in a desired building and assembled in the building. The safety portal system can then be secured in its desired location within the building.

DETAILED DESCRIPTION OF THE DISCLOSURE

Figure 1:
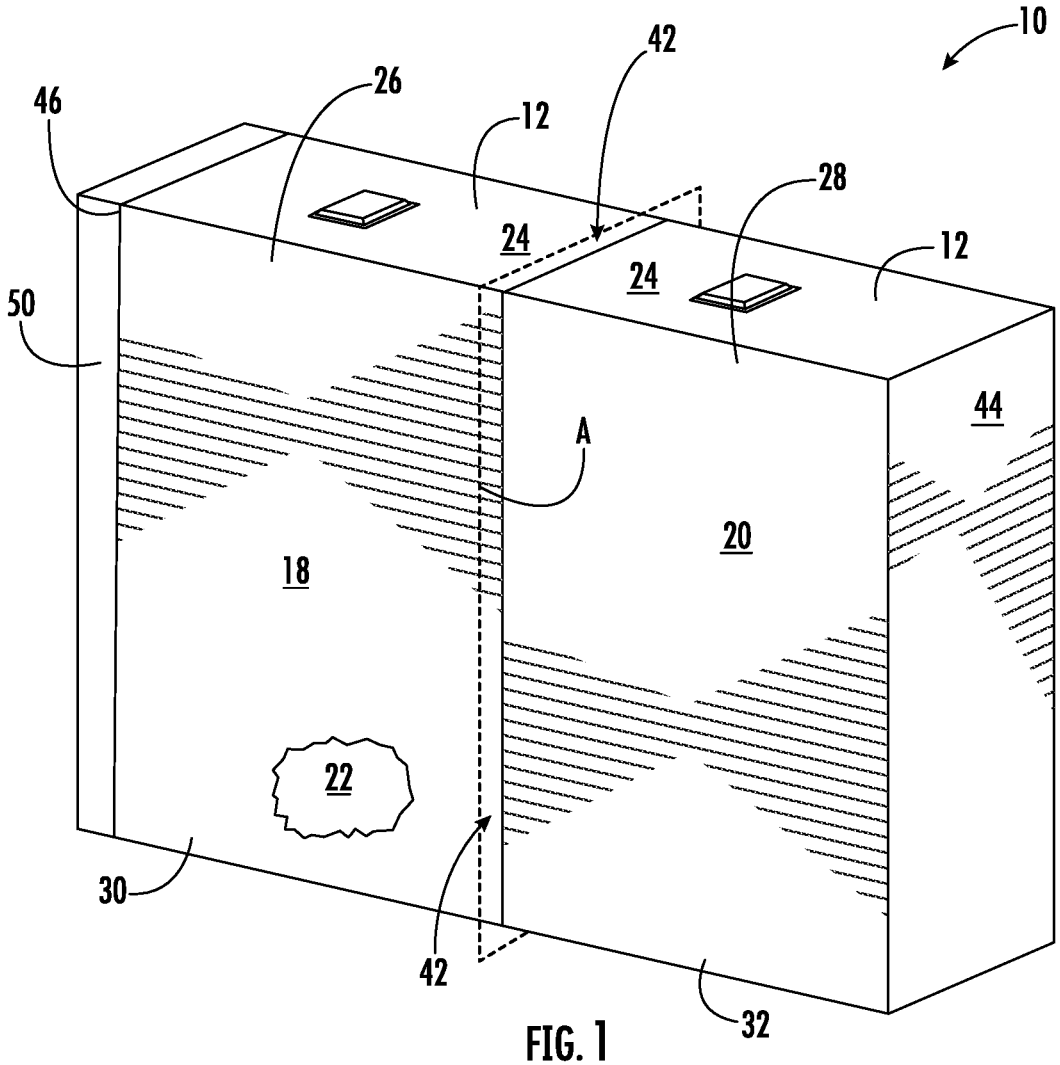
FIG. 1 is a perspective view of a safety portal system constructed in accordance with the present disclosure.
Figure 2A:
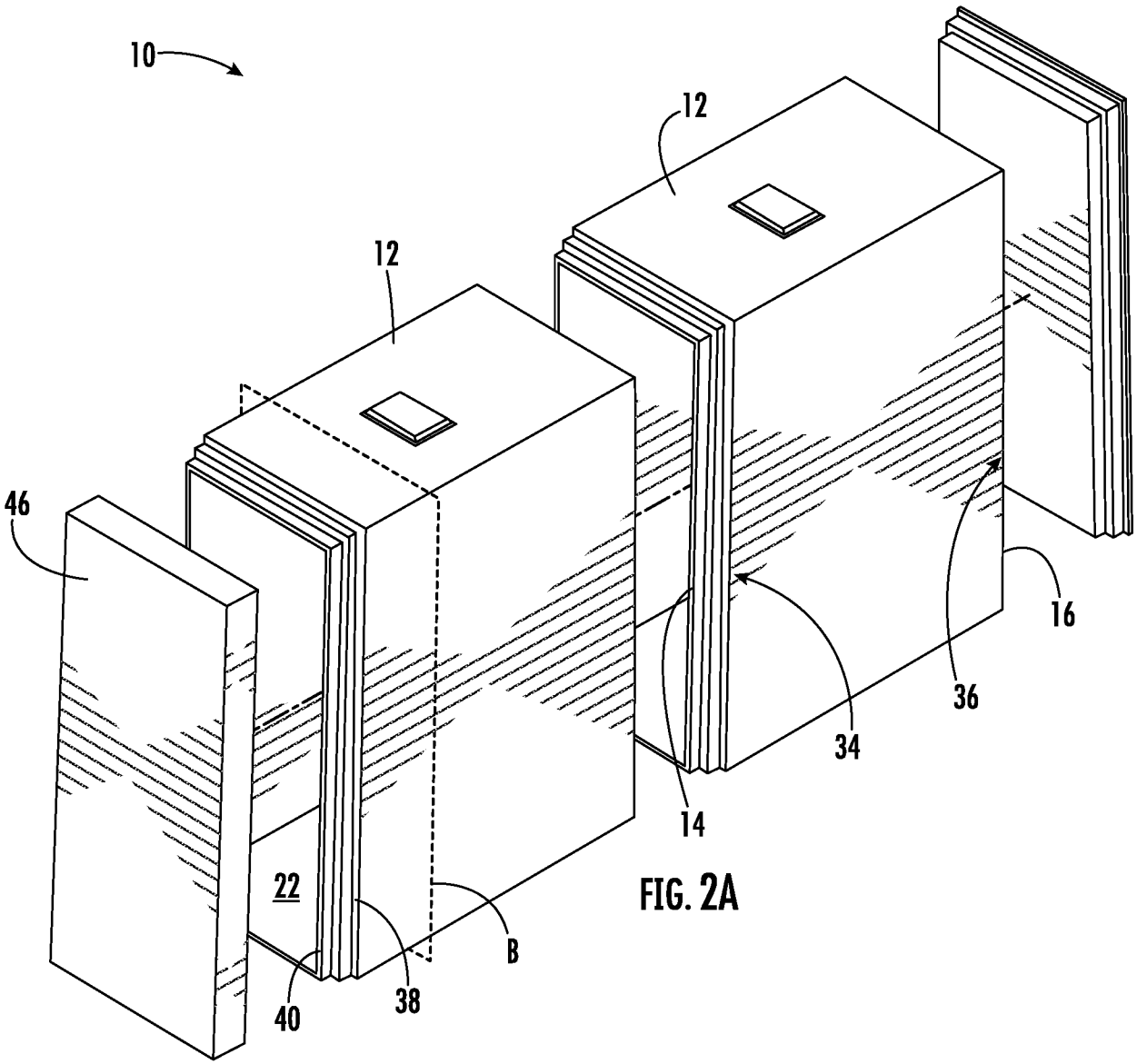
FIGS. 2A and 2B are exploded, perspective views of the safety portal system constructed in accordance with the present disclosure.
Figure 2B:
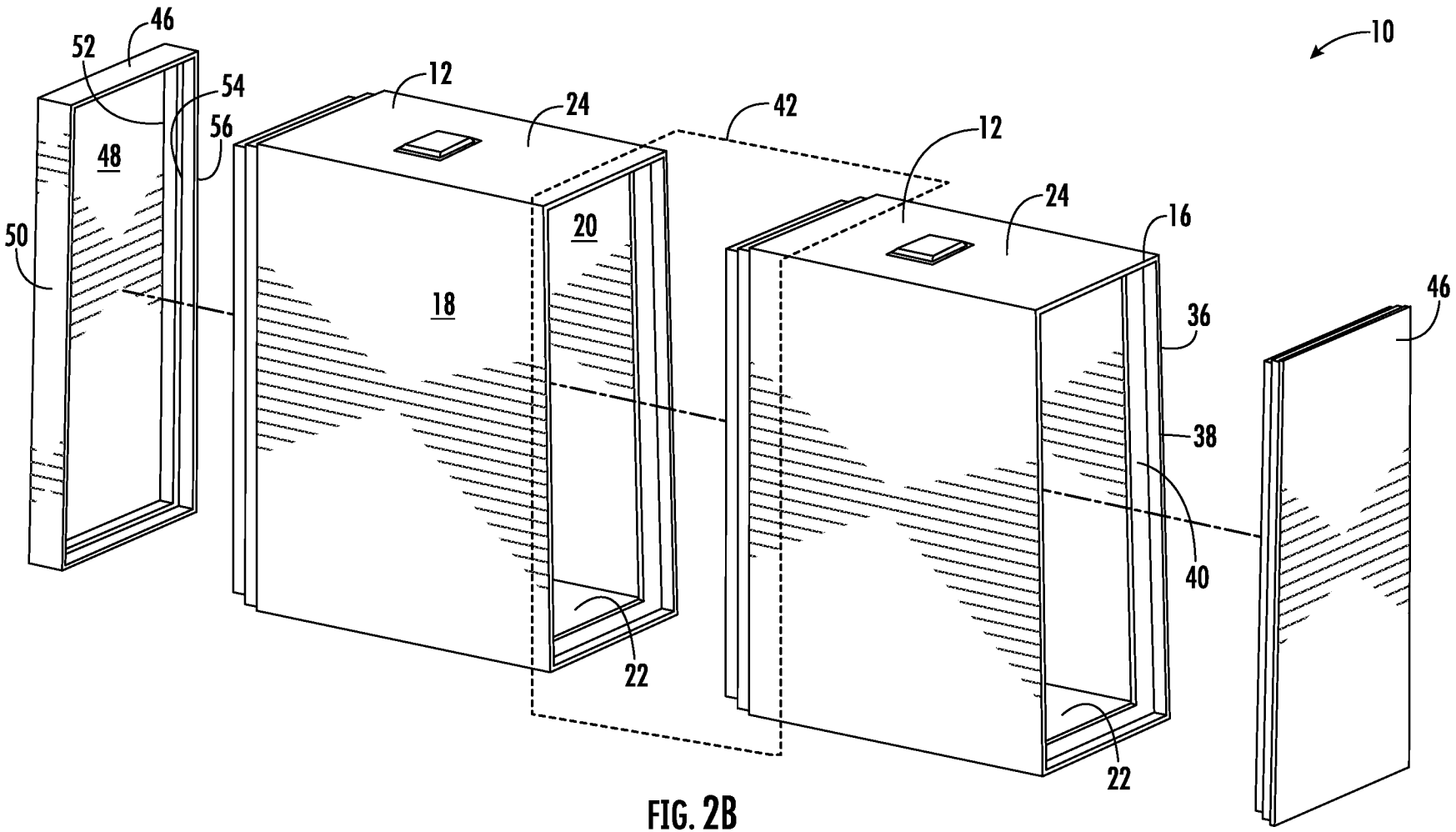
Figure 3:
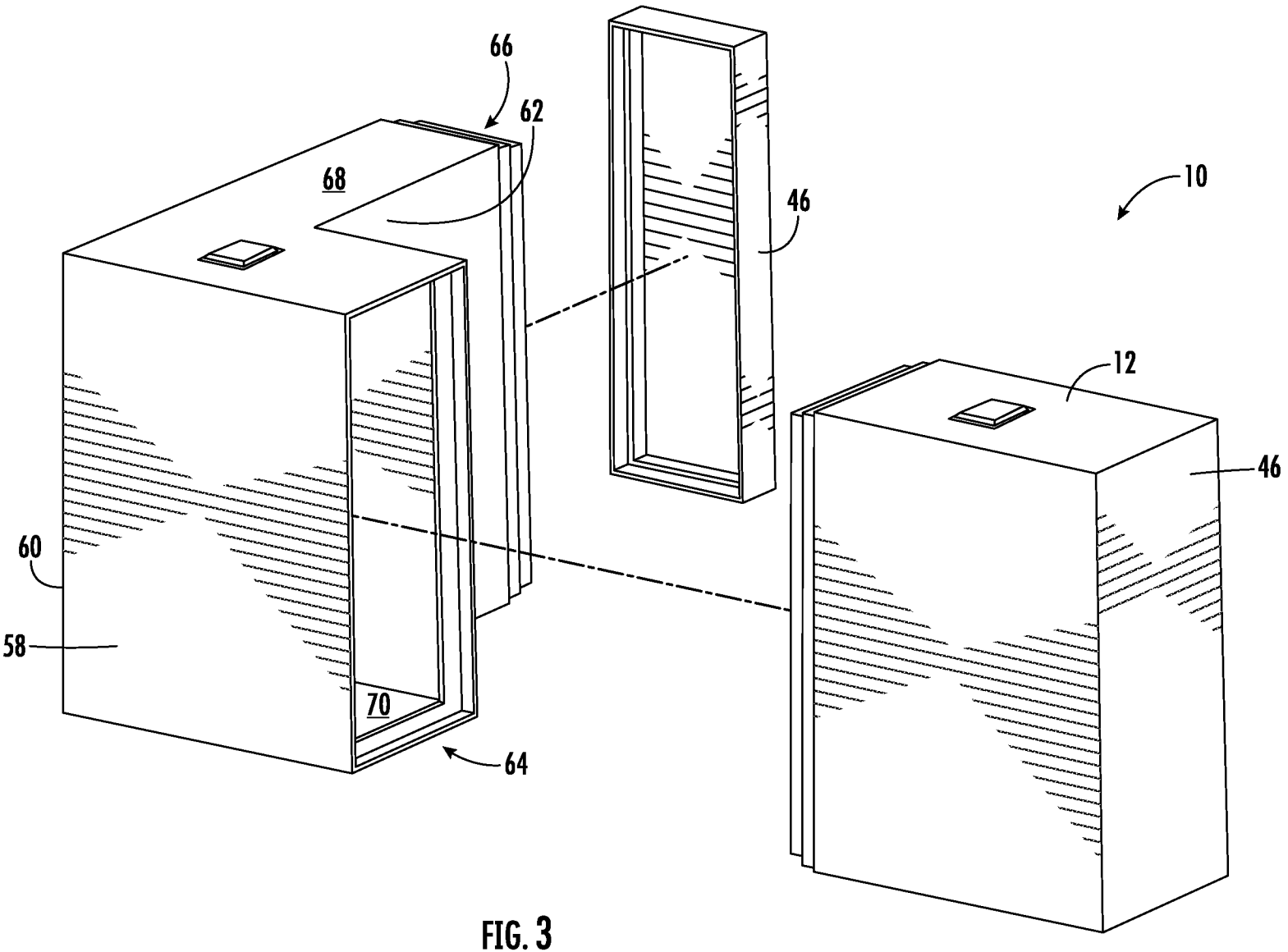
FIG. 3 is a perspective view of another embodiment of the safety portal system constructed in accordance with the present disclosure.
Figure 4A:
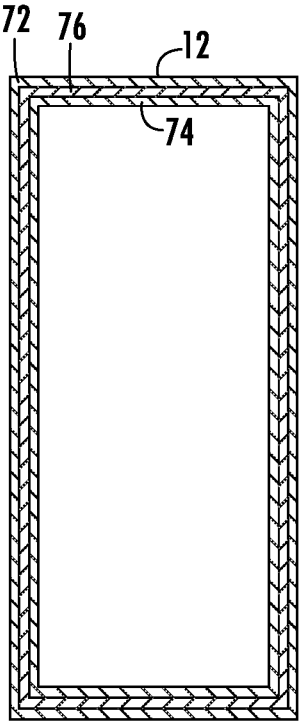
FIGS. 4A and 4B are cross-sectional views of a portion of the safety portal system constructed in accordance with the present disclosure.
Figure 4B:
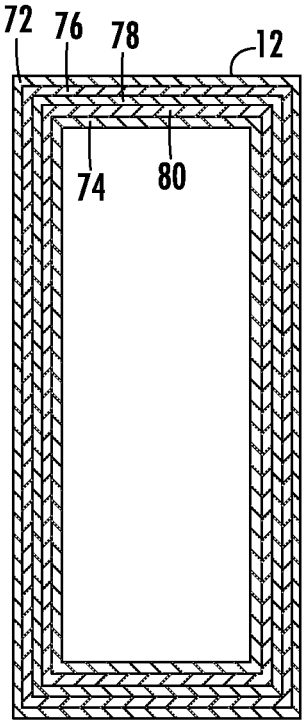
Figure 5A:
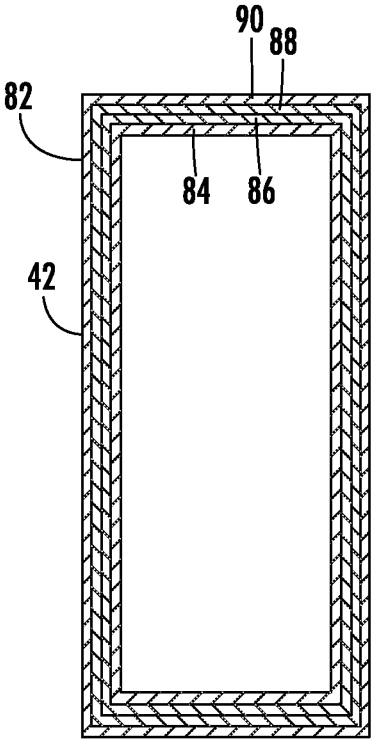
FIGS. 5A and 5B are cross-sectional views of another portion of the safety portal system constructed in accordance with the present disclosure.
Figure 5B:
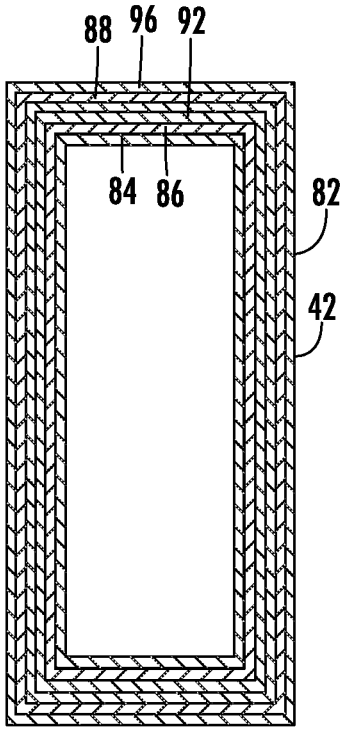

The present disclosure relates to a safety portal system 10 for placement into existing buildings to provide an area of protection from ballistic projectiles for occupants of the buildings. The safety portal system 10 can include multiple portal sections 12 that can be joined to create the desired size safety portal system 10. Each safety portal system 10 can be configured to fit in part of a room of an existing building. The safety portal system 10 can be designed to go around an inside corner in a room and/or around an outside corner in a room.

Depending on the layout of a specific safety portal system 10, each portal section 12 can have two open ends 14 and 16, two wall portions 18 and 20, a floor portion 22 and a ceiling portion 24. Each wall portion 18, 20 can have a corresponding top end 26 and 28, respectively, is connected to the ceiling portion 24 and a corresponding bottom end 30 and 32, respectively, that is connected to the floor portion 22. Each portal section 12 can have a first edge 34 and a second edge 36 that define the open ends 14 and 16, respectively, of the portal section 12. The edges 34 and 36 can be designed to cooperate with the edges 34 or 36 of other portal sections 12 in the safety portal system 10. One type of edge 34 or 36 of a portal section 12 can have is an outer edge 38 and another type of edge 34 or 36 of a portal section 12 can have is an inner edge 40. The inner edges 40 are designed to fit inside the outer edges 38 to generate a protective overlap section 42 of the portal sections 12 in the safety portal system 10. In another embodiment, the portal section 12 can include a third wall portion 44 and have only one open end 14.

Each safety portal system 10 can have a cap section 46 that is adapted to fit on the end 14 or 16 of a portal section 12. The cap section 46 can be adapted to fit with an outer edge 38 or inner edge 40 of a particular portal section 12. The cap section 46 will include a plate portion 48 with a flange 50 that extends away from and runs around the edge 52 of the plate portion 48. Similar to the edges 34 and 36 of the portal sections 12, the flange 50 of the cap section 46 can have an inner flange portion 54 or an outer flange portion 56. The inner flange portion 54 is designed to fit inside the outer edge 38 of the end 14 or 16 of a portal section 12. Conversely, if the cap section 46 is configured with an outer flange portion 56, the outer flange portion 56 is designed to fit around the inner edge 40 of the end 14 or 16 of the portal section 12.

In another embodiment, the safety portal system 10 can include a corner portal section 58. The corner portal section 58 can include an outer corner wall portion 60, an inner corner wall portion 62, a two open ends 64 and 66, a ceiling portion 68 and a floor portion 70. The outer corner wall portion 60 is designed to fit against an inside corner in a room when the safety portal system 10 is set against an inside corner. Similarly, the inner corner wall portion 62 is designed to fit against an outside corner when the safety portal system 10 goes around an existing corner. The open ends 64 and 66 of the corner portal section 58 can be an outer edge 38 or an inner edge 40 similar to the edges 38 and 40 previously described for the portal sections 12. Furthermore, the corner portal section 58 can be implemented with only a single open end 64 wherein other portal sections 12 are adjoinable from one end.

The walls 18, 20, 60 and 62, ceilings 24 and 68 and floors 22 and 70 of the portal sections 12, 58 and the flanges 50 and plate portions 48 of the cap sections 46 will be constructed of a structural material and a ballistic proof material. The structural material is used to support the safety portal system 10 and the ballistic proof material is used to prevent ballistic projectiles from entering the safety portal system 10. In one embodiment, the walls 18, 20, 60 and 62, ceilings 24 and 68 and floors 22 and 70 of the portal sections 12, 58 and the flanges 50 and plate portions 48 of the cap sections 46 can include a first layer of structural material 72 and a second layer of structural material 74 with a ballistic proof material layer 76 disposed between the first and second structural material layers 72 and 74. In another embodiment, the walls 18, 20, 60 and 62, ceilings 24 and 68 and floors 22 and 70 of the portal sections 12, 58 and the flanges 50 and plate portions 48 of the cap sections 46 can include a first layer of structural material 72, a second layer of structural material 74 and a third layer of structural material 78 with a first ballistic proof material layer 76 disposed between the first and second structural material layers 72 and 74 and a second ballistic proof material layer 80 disposed between the second and third layers of structural material 74 and 78.

The thickness of each structural material layer and ballistic material layer depends on the specific needs of the safety portal system 10. Similarly, the number of layers of the structural material and the ballistic proof material is dependent upon the parameter of the safety portal system 10 being designed.

The inner edge 40 and the outer edge 38 of the portal sections 12, 58 are thinner than the remaining portions of the portal sections 12, 58 to facilitate the engagement of the edges 34, 36, and thus, portal sections 12, 58. The inner edge 40 of one portal section 12, 58 slides into the outer edge 38 of another portal section 12, 58 and creates an engaged edge section 82. In one embodiment, when the safety portal system 10 has the two structural material layers 72 and 74 and the one ballistic proof layer 76, the engaged edge section 82 can essentially be a layer of structural material 84 from the inner edge 40, a layer of ballistic proof material 86 from the inner edge 40, a layer of ballistic material 88 from the outer edge 38 and a layer of structural material 90 from the outer edge 38. In another embodiment, the two layers of ballistic proof material 86 and 88 from the inner and outer edges 40 and 38 can be separated by a thin layer of structural material 92 on the inner edge 40 and a thin layer of structural material 38 on the outer edge 38.

The structural material can be any material known in the art capable of maintaining the structural integrity of the safety portal system 10 and supporting the ballistic proof material as discussed herein. The ballistic proof material can be any material known in the art capable of stopping ballistic projectiles. The walls of the portal sections 12, 58 and the plate portions of the cap sections can have doors disposed therein to permit occupants of the building access to the safety portal system 10. The seams created by the doors can include a layer of structural material and ballistic proof material to prevent ballistic projectiles from taking advantage of the seam areas.

The cap sections 46 and the portal sections 12, 58 can be secured to each other by any means known in the art. For example, they could be bolted together or screwed together. The portal sections 12, 58 can also be secured to the floor of a building to maintain a desired position of the safety portal system 10 in the building. The safety portal system 10 can be secured to the floor of the building in any manner known in the art, such as via screws or bolts. The safety portal system 10 can include a door in any part thereof to permit access. The door would have the same structural and ballistic properties that the other portions of the safety portal system 10 have. In one embodiment, the cap sections 46 could be hingedly connected to the portal sections 12, 58 and lockable from the inside of the safety portal system 10.

From the above description, it is clear that the present disclosure is well adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A safety portal system, the system comprising:

a first portal section having a first wall and a second wall, a first open end, a floor portion and a ceiling portion, the first open end defined by an outer edge;

a second portal section having a first wall and a second wall, a first open end, a floor portion and a ceiling portion, the first open end of the second portal section defined by an inner edge that cooperates and engages with the outer edge of the first portal section to create a protective overlap section; and wherein the walls, ceiling portions and floor portions of the portal sections include a first layer of structural material, a second layer of structural material, a first layer of ballistic proof material disposed between the first and second layers of structural material, a third layer of structural material, and a second layer of ballistic proof material disposed between the second and third layers of structural material.

2. The safety portal system of claim 1 further comprising a cap section that can be configured to be secured to a second open end of the first portal section or a second open end of the second portal section.

3. The safety portal system of claim 1 further comprising a corner portal section that has an outer corner wall portion and inner corner wall portion.

4. The safety portal system of claim of claim 1 wherein the protective overlap section includes a layer of structural material and a layer of ballistic proof material.

5. The safety portal system of claim 1 wherein the protective overlap section includes a first layer of structural material and a first layer of ballistic proof material disposed on the outer edge of the first portal section and a second layer of structural material and a second layer of ballistic proof material disposed on the inner edge of the second portal section.

6. The safety portal system of claim 5 wherein the first and second layers of ballistic proof material are disposed adjacent to each other when the first and second portal sections are secured together.

7. The safety portal system of claim 1 wherein the protective overlap section includes a first layer of structural material, a first layer of ballistic proof material and a second layer of structural material disposed on the outer edge of the first portal section and a third layer of structural material, a second layer of ballistic proof material and a fourth layer of structural material disposed on the inner edge of the second portal section.

8. A method of installing a safety portal system, the method comprising:

positioning a safety portal system in a desired building, the safety portal system comprising:

a first portal section having a first wall and a second wall, a first open end, a floor portion and a ceiling portion, the first open end defined by an outer edge;

a second portal section having a first wall and a second wall, a first open end, a floor portion and a ceiling portion, the first open end of the second portal section defined by an inner edge that cooperates and engages with the outer edge of the first portal section to create a protective overlap section; and wherein the walls, ceiling portions and floor portions of the portal sections include a first layer of structural material, a second layer of structural material, a first layer of ballistic proof material disposed between the first and second layers of structural material, a third layer of structural material, and a second layer of ballistic proof material disposed between the second and third layers of structural material;

assembling the safety portal system in the building; and securing the safety portal system in the building.

9. The method of claim 8 wherein the safety portal system further comprises a cap section that can be configured to be secured to a second open end of the first portal section or a second open end of the second portal section.

10. The method of claim 8 wherein the safety portal system further comprises a corner portal section that has an outer corner wall portion and inner corner wall portion.

11. The method of claim of claim 8 wherein the protective overlap section includes a layer of structural material and a layer of ballistic proof material.

12. The method of claim 8 wherein the protective overlap section includes a first layer of structural material and a first layer of ballistic proof material disposed on the outer edge of the first portal section and a second layer of structural material and a second layer of ballistic proof material disposed on the inner edge of the second portal section.

13. The method of claim 12 wherein the first and second layers of ballistic proof material are disposed adjacent to each other when the first and second portal sections are secured together.

14. The method of claim 8 wherein the protective overlap section includes a first layer of structural material, a first layer of ballistic proof material and a second layer of structural material disposed on the outer edge of the first portal section and a third layer of structural material, a second layer of ballistic proof material and a fourth layer of structural material disposed on the inner edge of the second portal section.

* * * * *